US007517191B1

(12) United States Patent
Bein et al.

(10) Patent No.: US 7,517,191 B1
(45) Date of Patent: Apr. 14, 2009

(54) OPERATIONAL MAINTENANCE OF AIR-CONDITIONING INSTALLATIONS

(75) Inventors: Thomas Bein, Gambrills, MD (US); Matthew Frank, Chadds Ford, PA (US); William L. Tucker, Turnersville, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 509 days.

(21) Appl. No.: 11/250,705

(22) Filed: Oct. 6, 2005

(51) Int. Cl.
*F03B 11/02* (2006.01)

(52) U.S. Cl. ..... 415/201; 29/266; 269/95; 269/96

(58) Field of Classification Search ..... 415/201, 415/214.1; 81/120, 125, 176.3, 176.2; 269/3, 269/6, 95, 96, 238; 254/21, 22, 23; 29/278, 29/218.1, 266
See application file for complete search history.

(56) References Cited

U.S. PATENT DOCUMENTS 5,423,304 A * 6/1995 Lawrence et al. ..... 123/559.1

* cited by examiner

*Primary Examiner*—Edward Look
*Assistant Examiner*—Dwayne J White
(74) *Attorney, Agent, or Firm*—Dave A. Ghatt; Jacob Shuster

(57) ABSTRACT

An assembled pump compressor arrangement of an air-conditioning system having a housing enclosing an impeller with a thrust collar positioned thereon. The arrangement includes a tool for applying torque to the impeller having an outer cylindrical element and a plurality of arcuate sections. The arrangement further includes a releasable clamp for interconnecting the arcuate sections and the outer cylindrical element with the impeller clamped between the outer cylindrical element and the arcuate sections. A torque bar is provided which extends through the outer cylindrical element in a spaced relation to the impeller through which the torque is applied to effect disassembly of the high-speed thrust collar and removal of the impeller from the housing of the air-conditioning system.

6 Claims, 3 Drawing Sheets

FIG. 3
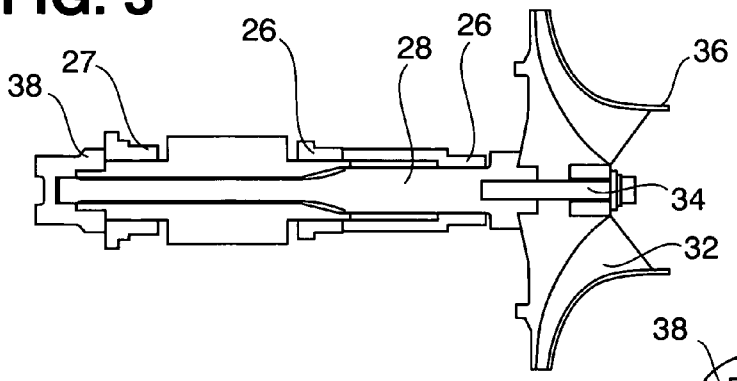
FIG. 4
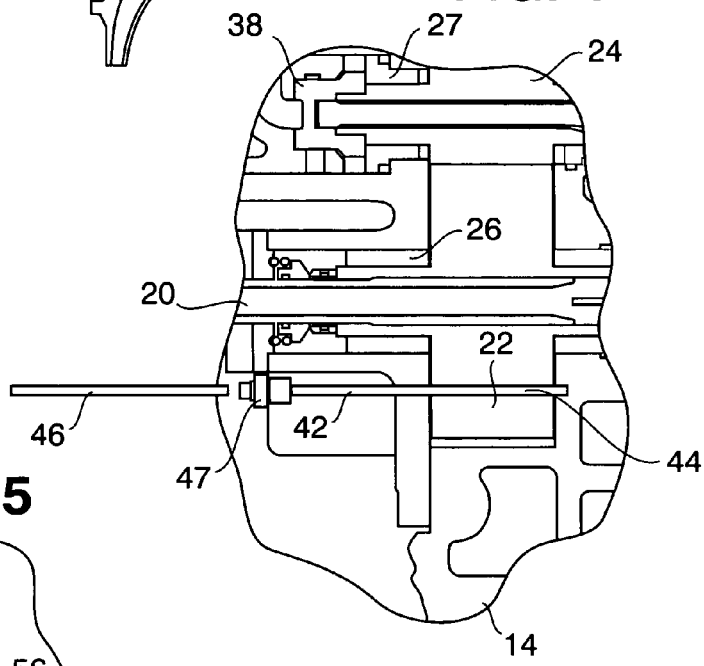
FIG. 5
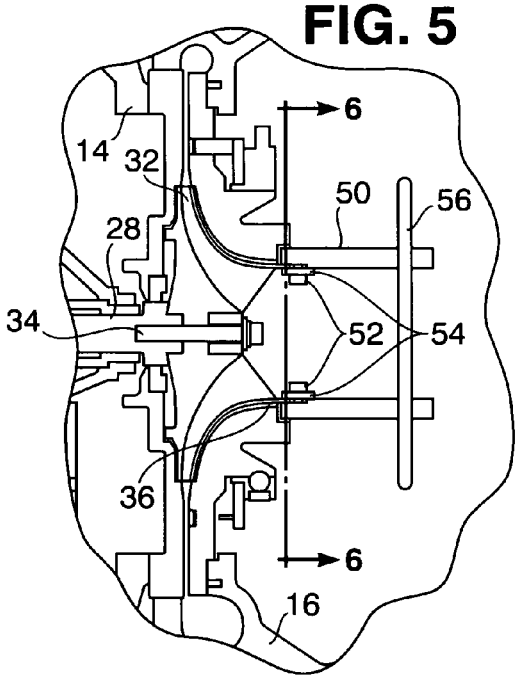
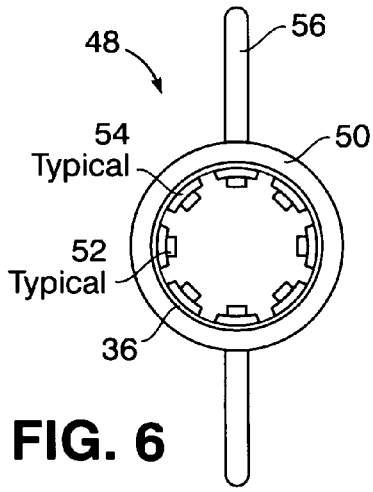
FIG. 6

OPERATIONAL MAINTENANCE OF AIR-CONDITIONING INSTALLATIONS

STATEMENT OF GOVERNMENT INTEREST

The invention described herein may be manufactured and used by or for the Government of the United States of America for governmental purposes without the payment of any royalties thereon or therefore.

The present invention relates generally to periodic replacement of parts to maintain prolonged operation of an air-conditioning system.

BACKGROUND OF THE INVENTION

A centrifugal compressor pump having an impeller driven at a high speed by a motor drivingly connected thereto by gearing supported by hydrodynamic and thrust bearings positioned within a rigid sealed housing of an air-conditioning system, is generally known in the art and manufactured by York International (Model LTMN). In order to prolong the operational condition of such air-conditioning system, it is necessary to periodically inspect and/or replace the high-speed thrust bearing collar and high-speed thrust bearings as parts associated therewith. Such thrust bearing collar is threaded into right-hand threads of a high-speed shaft and into left-hand threads of a pinion gear, making replacement of parts typical involved in disassembly and reassembly of the compressor costly and time-consuming and requiring rigging of heavy equipment with frequent damage and/or rupture of parts. It is therefore an important object of the present invention to provide for inspection and periodic replacement of the high-speed thrust bearing collar and the bearings of the foregoing referred to centrifugal compressor type of air-conditioning system by personnel in a more rapid and less costly manner with little likelihood of damage and/or rupture of parts.

SUMMARY OF THE INVENTION

Pursuant to the present invention, the housing enclosing inlet pre-rotational vanes of a compressor, the high-speed pump housing thereof and sealing fastener associated therewith, are removed to expose the compressor impeller, the high-speed thrust collar and access hole of the compressor. Removal of the sealing fastener allows insertion of a locking pin into the housing and the access hole to prevent gear rotation. With the vane housing removed, a special tool is then clamped onto an exposed portion of the compressor impeller. With the high-speed housing removed, application of torque may then be applied in order to threadly disconnect the high-speed thrust collar from the impeller high-speed drive shaft and pinion gear. The special tool is designed to interlock with the pump end of the high-speed thrust collar so as to rotate the high-speed thrust collar clockwise, while rotation of the special tool clamped to the impeller is effected counterclockwise. By such rotation of the special tool, with clearance maintained between the impeller and the compressor housing scroll, the high-speed thrust collar may be unthreaded from the left-hand thread of the pinion gear. Once unthreaded from the pinion gear, the high-speed thrust collar is rotated counterclockwise to unthread it from the right-hand threads of the high-speed impeller drive shaft for removal. Once the high-speed thrust collar is removed, the high-speed thrust bearing can then be removed from the compressor housing with typical bearing pullers. The centrifugal compressor is thereafter reassembled in reverse order after inspection and/or replacement of the high-speed thrust collar and the high-speed thrust bearings. The foregoing procedure is reversed to return the centrifugal compressor to its operational condition.

BRIEF DESCRIPTION OF THE DRAWING

A more complete appreciation of the invention and many of its attendant advantages will be readily appreciated as the same becomes better understood by reference to the following detailed description when considered in connection with the accompanying drawing wherein:

FIG. 3 is a side section view of the disassembled impeller associated with the compressor shown in FIGS. 1 and 2;

FIG. 4 is a partial side section view of the compressor shown in FIGS. 1-3, with the locking pin removed;

FIG. 5 is a partial side section view of the compressor as shown in FIG. 2 with a special torque applying tool attached to the compressor;

FIG. 6 is a transverse section view of the special tool, taken substantially through a plane indicated by section line 6-6 in FIG. 5.

DETAILED DESCRIPTION OF PREFERRED EMBODIMENT

Figure 1:
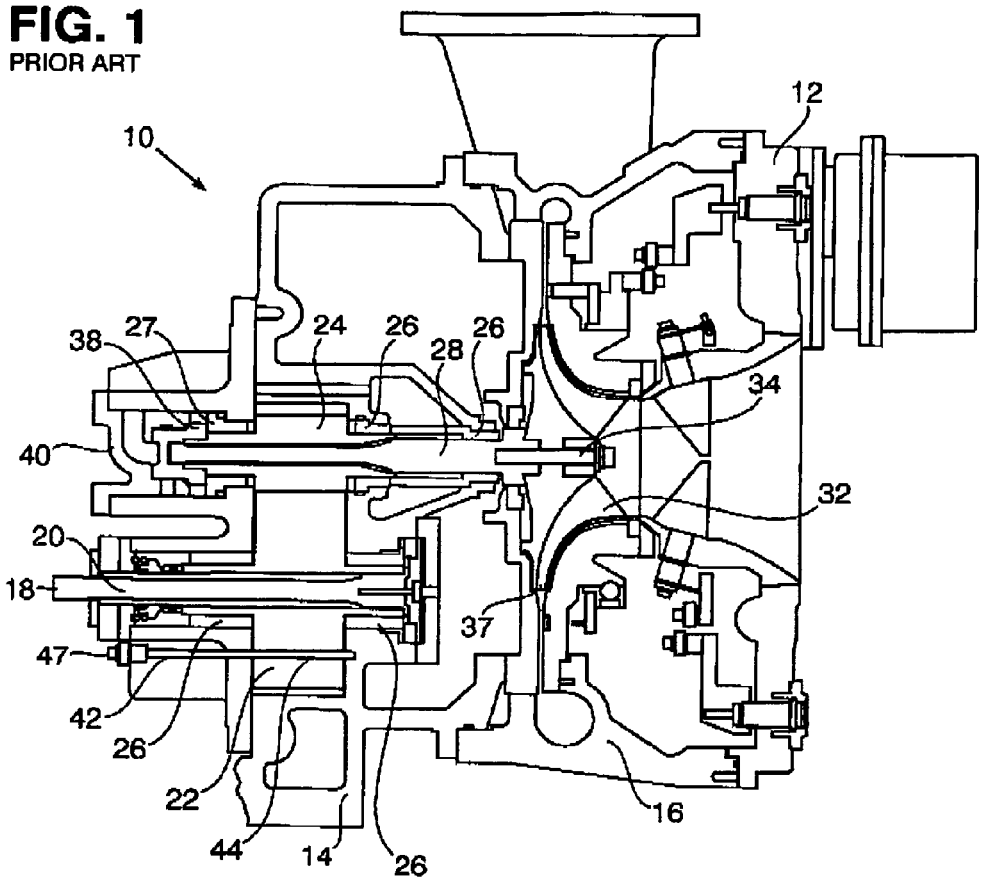
FIG. 1 PRIOR ART
FIG. 1 is a side section view of a centrifugal air-conditioning compressor installation.
Figure 2:
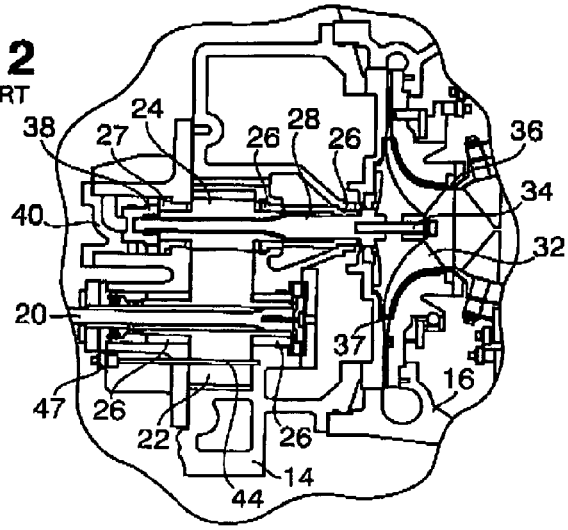
FIG. 2 PRIOR ART
FIG. 2 is a partial side section view of the air-conditioning compressor shown in FIG. 1, with its pre-rotational vane housing removed.

Referring now to the drawing in detail, FIGS. 1 and 2 illustrate a centrifugal pump compressor 10 of a type generally known in the art, within an air-conditioning installation having a housing 12 enclosing pre-rotational vanes. The compressor 10 has a rotor support housing 14 releasably attached to a scroll housing 16 attached to the housing 12. Through a coupling 18 as diagrammatically shown in FIG. 1, a compressor motor transmits rotational power to a drive shaft 20 extending into the housing 14 and connected therein to a main gear 22 enmeshed with a pinion gear 24. The gears 22 and 24 are respectively journaled radially within the housing 14 by bearings 26 and a high speed thrust bearing 27 and longitudinally by a thrust collar 38 abutting the high speed thrust bearing 27. The pinion gear 24 is connected by a main drive shaft 28 to a pump impeller 32 for rotation thereof about an axis 34 in order to induce outflow of pressurized fluid, such as refrigerant, from an outlet end portion 37 of the impeller 32 into the scroll housing 16. A high-speed pump cover 40 and the housing 12 respectively are removably attached to the housings 14 and 16 so as to enclose therein a high-speed thrust collar 38 and the impeller 32. The thrust collar 38 is threaded at two different diameters thereof to the pinion gear 24 and the high-speed main shaft 28 so as to sustain axial loading by means of a hydrodynamic film associated with the high-speed thrust bearing 27.

As shown in FIG. 3, the impeller 32 is accessible after removal of the housing 12 so as to expose an impeller end portion 36 for attachment of the impeller 32 to a special tool 48 as shown in FIG. 5 and hereinafter described. With the pump cover 40 removed so as to expose the thrust collar 38, it may be unthreaded and removed. Once the thrust collar 38 is removed, the high-speed thrust bearing 27 can be removed by use of a bearing puller. FIG. 4 shows an access opening 42 formed in the housing 14 in alignment with a hole 44 formed in the main gear 22, into which a locking pin 46 is inserted after removal of a sealing fastener 47 from the housing 14. Insertion of the locking pin 46 prevents the gears 22 and 24 from rotating to thereby enable unthreading of the high-speed thrust collar 38 and removal thereof from the compressor 10 for replacement of the high-speed thrust bearing 27 as hereinafter explained.

Pursuant to the present invention, a special tool 48, as shown in FIGS. 5 and 6, is positioned on the exposed portion 36 of the disassembled impeller 32. The tool 48 features eight (8) arcuate sections 54 forming an inner cylindrical portion that is connected to an outer cylindrical element 50 by threaded fasteners 52 extending from the arcuate sections 54 into the outer cylindrical element 50 which is somewhat thicker than the inner cylindrical tool portion formed by the arcuate sections 54. A torque rod 56 is extended diametrically through the outer cylindrical element 50. The impeller end portion 36 is clamped between the outer cylindrical tool element 50 and the arcuate sections 54 as shown in FIG. 5. By force applied to the torque bar 56 of the tool 48, personnel may readily and easily exert rotational torque on the impeller 32 in order to disconnect the connections to the high-speed thrust collar 38 as hereinafter described.

Figure 7:
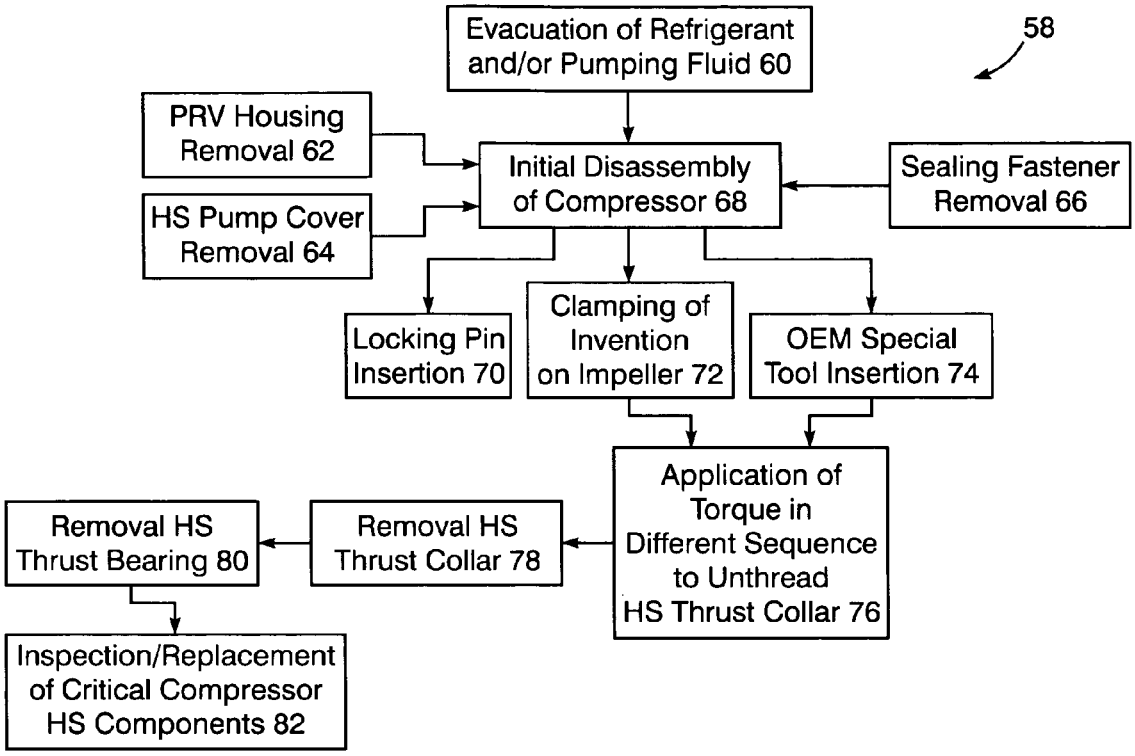
FIG. 7 is a block diagram of a parts replacement procedure associated with the air-conditioning installation shown in FIGS. 1-6.

Referring now to FIG. 7, a procedure 58 is diagrammed for periodic inspection and/or replacement of the high-speed thrust collar 38 and the high-speed thrust bearing 27 from the centrifugal compressor 10 hereinbefore described. Initially, evacuation 60 of refrigerant and/or pumping fluid is effected. Then removal 62 of the housing 12 from the compressor 10 is effected by disconnection from the scroll housing 16. Removal 64 of the pump cover 40 from the compressor 10 is then effected, followed by removal 66 of the sealing fastener 47 to complete the initial compressor disassembly 68. Insertion 70 of the locking pin 46 is then required to prevent rotation of the gears 22 and 24. Clamping 72 of the tool 48 onto the exposed end portion 36 of the impeller 32 is then effected. Installation 74 of the special tool 48, designed to interlock with the pump end of the high-speed thrust collar 38, is then effected followed by torque application 76 in different sequences through the torque bar 46 and another tool to release the threaded connections of the high-speed thrust collar 38. When completely unthreaded, removal 78 of the high-speed thrust collar 38 is effected. Sequential removal 80 of the high-speed thrust bearing 27 is then effected for inspection and/or replacement 82 thereof to complete the procedure 58.

Obviously, other modifications and variations of the present invention may be possible in light of the foregoing teachings. It is therefore to be understood that within the scope of the appended claims the invention may be practiced otherwise than as specifically described.

What is claimed is:

1. In combination with an assembled pump compressor of an air-conditioning system having a housing enclosing an impeller with a thrust collar positioned thereon; a tool for applying torque to the impeller comprising: an outer cylindrical element; a plurality of arcuate sections; releasable clamp means for interconnecting said arcuate sections and the outer cylindrical element with the impeller clamped between the outer cylindrical element and the arcuate sections; and a torque bar extending through the outer cylindrical element in spaced relation to the impeller through which said torque is applied to effect disassembly of the high-speed thrust collar and removal of the impeller from the housing of the air-conditioning system.

2. The combination as defined in claim 1, wherein said pump compressor includes bearings within the housing on which the impeller is positioned and which is exposed upon said disassembly of the high-speed thrust collar.

3. A compressor within an air-conditioning installation comprising:

a scroll housing;

a rotor housing releasably attached to the scroll housing, said rotor housing including a gearing arrangement therewithin;

impeller means positioned to induce an outflow of fluid under pressure through the scroll housing in response to rotation imparted through the gearing arrangement within the rotor housing;

a bearing arrangement rotationally supporting the gearing arrangement; and removable cover means protectively enclosing the gearing arrangement within the rotor housing for enabling insertion or removal of the bearing arrangement therefrom, the compressor further comprising:

tool means for applying torque to the impeller means comprising: an outer cylindrical element attached to the impeller means with arcuate sections; and a torque bar extending through the outer cylindrical element in spaced relation to the impeller means through which said torque is applied to effect disassembly of the thrust bearing means from the air-conditioning system.

4. The combination as defined in claim 3, wherein said gearing arrangement comprises: a pinion gear connected to the impeller means; a main gear enmeshed with the pinion gear; and a drive shaft connected to the main gear through which said imparted rotation is applied to the impeller means.

5. The combination as defined in claim 4, wherein said impeller means has an exposable end portion to which the outer cylindrical element of the impeller means is attached after removal from the scroll housing.

6. The combination as defined in claim 3, wherein said impeller means has an exposable end portion to which the tool means is attached after removal from the scroll housing.

* * * * *